US007891942B2

(12) United States Patent
Hsu

(10) Patent No.: US 7,891,942 B2
(45) Date of Patent: Feb. 22, 2011

(54) CENTRIFUGAL BLOWER

(75) Inventor: Nien-Hui Hsu, Hsinchu (TW)

(73) Assignee: Coretronic Corporation, Hsin-Chu (TW)

( * ) Notice: Subject to any disclaimer, the term of this patent is extended or adjusted under 35 U.S.C. 154(b) by 806 days.

(21) Appl. No.: 11/868,541

(22) Filed: Oct. 8, 2007

(65) Prior Publication Data

US 2009/0155059 A1 Jun. 18, 2009

(30) Foreign Application Priority Data

Mar. 27, 2007 (TW) ..... 96110697 A

(51) Int. Cl.
*F04D 29/44* (2006.01)
*F04D 29/16* (2006.01)
*F04D 29/42* (2006.01)

(52) U.S. Cl. ..... 415/184; 415/94; 415/185; 415/186; 415/206; 416/189; 416/192; 416/223 B

(58) Field of Classification Search ..... 415/93, 415/94, 98, 170.1, 184, 185, 186, 203, 204, 415/205, 206, 228; 416/185, 186 R, 189, 416/192, 223 B
See application file for complete search history.

(56) References Cited

U.S. PATENT DOCUMENTS 3,407,995 A * 10/1968 Kinsworthy ..... 415/94
3,684,396 A * 8/1972 Ball et al. ..... 415/52.1
4,432,694 A * 2/1984 Kuroda et al. ..... 415/172.1
5,281,092 A * 1/1994 Sullivan ..... 415/206
5,352,089 A * 10/1994 Tokunaga et al. ..... 415/206
5,511,939 A * 4/1996 Tokunaga et al. ..... 415/206
5,813,831 A * 9/1998 Matsunaga et al. ..... 415/173.6
5,997,246 A * 12/1999 Humbad ..... 415/119
6,299,409 B1 * 10/2001 Matsunaga et al. ..... 415/206
6,450,765 B1 9/2002 Carroll et al.
6,604,906 B2 * 8/2003 Ozeki et al. ..... 415/204
6,802,699 B2 * 10/2004 Mikami et al. ..... 417/369

(Continued)

FOREIGN PATENT DOCUMENTS

JP 07-301196 11/1995

(Continued)

OTHER PUBLICATIONS

"Notice of Allowance of Taiwan counterpart application", issued on Dec. 23, 2009, p. 1-p. 4.

*Primary Examiner*—Igor Kershteyn
(74) *Attorney, Agent, or Firm*—Jianq Chyun IP Office

(57) ABSTRACT

A centrifugal blower includes a casing, a motor fixed in the casing, a fan structure, and an anti-leakage element. The casing has a top portion having an inlet, a bottom portion, and a side wall respectively connecting the top and bottom portions and having an outlet. The fan structure disposed in the casing and driven by the motor has a body connected to the motor and blades surrounding the body and being connected to the body, and rotates about an axis in a first rotation direction. The anti-leakage element extends from at least part of an edge of the inlet to an interior of the casing, partially covers parts of the blades, and extends from neighborhood of the outlet in a second rotation direction against the first rotation direction. A range of the anti-leakage element extending to the interior of the casing is gradually reduced along the second rotation direction.

10 Claims, 5 Drawing Sheets

U.S. PATENT DOCUMENTS 7,163,371 B2 * 1/2007 Higashida ..... 415/204

FOREIGN PATENT DOCUMENTS

TW 580164 3/2004
TW M250230 11/2004
TW I235205 7/2005
TW I235297 7/2005
TW I235792 7/2005

* cited by examiner

CENTRIFUGAL BLOWER

CROSS-REFERENCE TO RELATED APPLICATION

This application claims the priority benefit of Taiwan application serial no. 96110697, filed Mar. 27, 2007. All disclosure of the Taiwan application is incorporated herein by reference.

BACKGROUND OF THE INVENTION

1. Field of the Invention

The present invention relates to a centrifugal blower. More particularly, the present invention relates to a centrifugal blower having an anti-leakage element.

2. Description of Related Art

A blower is a machine capable of generating a differential pressure to force air to flow. A common axial fan blows an air flowing in a direction substantially parallel to a rotation axis of the axial fan. A centrifugal blower blows an air flowing in a direction substantially perpendicular to a rotation axis of the centrifugal blower.

FIG. 1A is a schematic perspective view of a conventional centrifugal blower, FIG. 1B is a schematic top view of the centrifugal blower of FIG. 1A, and FIG. 1C is a schematic cross-sectional view of the centrifugal blower of FIG. 1B taken along a line I-I'. Referring to FIGS. 1A, 1B, and 1C, the conventional centrifugal blower 100 includes a casing 110, a motor 120, and a fan structure 130. The casing 110 has a top portion 112, a bottom portion 114, and a side wall 116. The top portion 112 has an inlet 112*a*. A side 116*b* of the top portion 112 and a side 116*c* of the bottom portion 114 extend and are engaged together to form a side wall 116. The side wall 116 is connected to the top portion 112 and the bottom portion 114 respectively, and has an outlet 116*a*.

The motor 120 is fixed in the casing 110. The fan structure 130 is disposed in the casing 110. The fan structure 130 has a body 132 and a plurality of blades 134. The body 132 is connected to the motor 120, and the blades 134 surround the body 132 and are connected to the body 132. The fan structure 130 driven by the motor 120 rotates about an axis 10 in a rotation direction 20.

When the centrifugal blower 100 operates, the rotating fan structure 130 sucks in air via the inlet 112*a* and blows out the air via the outlet 116*a*. In specific, before entering the blades 134 via the inlet 112*a*, the air flows in a direction substantially parallel to the axis 10. After the air is pressurized by the blades 134, the air passes through an increased pressure flow chamber or a volute chamber 30 located between the blades 134 and the side wall 116, and moves away from the casing 110 via the outlet 116*a* in a direction substantially perpendicular to the axis 10.

However, the static pressure of the air flowing in the volute chamber 30 is generally greater than the pressure of the air at the inlet 112*a*, such that the air within the volute chamber 30 leaks through a clearance 40 between the top portion 112 of the casing 110 and each of the blades 134. Therefore, the conventional centrifugal blower 100 has lower operation efficiency.

SUMMARY OF THE INVENTION

The present invention is directed to providing a centrifugal blower having higher operation efficiency.

A centrifugal blower provided by the present invention includes a casing, a motor, a fan structure, and a first anti-leakage element. The casing has a top portion, a bottom portion, and a side wall. The top portion has a first inlet, and the side wall respectively connects the top portion and the bottom portion and has an outlet. The motor is fixed in the casing. The fan structure is disposed in the casing, and has a body and a plurality of blades. The body is connected to the motor, and the blades surround the body and are connected to the body. The fan structure driven by the motor rotates about an axis in a first rotation direction. The first anti-leakage element extends from at least part of a first edge of the first inlet to an interior of the casing and partially covers parts of the blades. The first anti-leakage element extends from neighborhood of the outlet in a second rotation direction against the first rotation direction. A range of the first anti-leakage element extending to the interior of the casing is gradually reduced along the second rotation direction.

The anti-leakage element of the present invention extends from at least part of the edge of the inlet to the interior of the casing, so when the centrifugal blower of the present invention operates, the air pressurized by the blades within the casing does not easily leak. Therefore, the centrifugal blower of the present invention has higher operation efficiency.

Additionally, as the range of the anti-leakage element of the present invention extending to the interior of the casing is gradually reduced against the rotation direction in which the fan structure rotates, when the centrifugal blower operates, the air within the casing having a static pressure gradually increased in the rotation direction in which the fan structure rotates does not easily leak. Furthermore, the intake rate of air at the inlet is not easily affected to greatly decrease by the anti-leakage element.

In order to make the aforementioned and other objects, features and advantages of the present invention comprehensible, preferred embodiments accompanied with figures are described in detail below.

Other objectives, features and advantages of the present invention will be further understood from the further technology features disclosed by the embodiments of the present invention wherein there are shown and described preferred embodiments of this invention, simply by way of illustration of modes best suited to carry out the invention.

BRIEF DESCRIPTION OF THE DRAWINGS

The accompanying drawings are included to provide a further understanding of the invention, and are incorporated in and constitute part of this specification. The drawings illustrate embodiments of the invention and, together with the description, serve to explain the principles of the invention.

DESCRIPTION OF THE EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," etc., is used with reference to the orientation of the Figure(s) being described. The components of the present invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the present invention. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Similarly, the terms "facing," "faces" and variations thereof herein are used broadly and encompass direct and indirect facing, and "adjacent to" and variations thereof herein are used broadly and encompass directly and indirectly "adjacent to". Therefore, the description of "A" component facing "B" component herein may contain the situations that "A" component facing "B" component directly or one or more additional components is between "A" component and "B" component. Also, the description of "A" component "adjacent to" "B" component herein may contain the situations that "A" component is directly "adjacent to" "B" component or one or more additional components is between "A" component and "B" component. Accordingly, the drawings and descriptions will be regarded as illustrative in nature and not as restrictive.

The First Embodiment

Figure 1A:
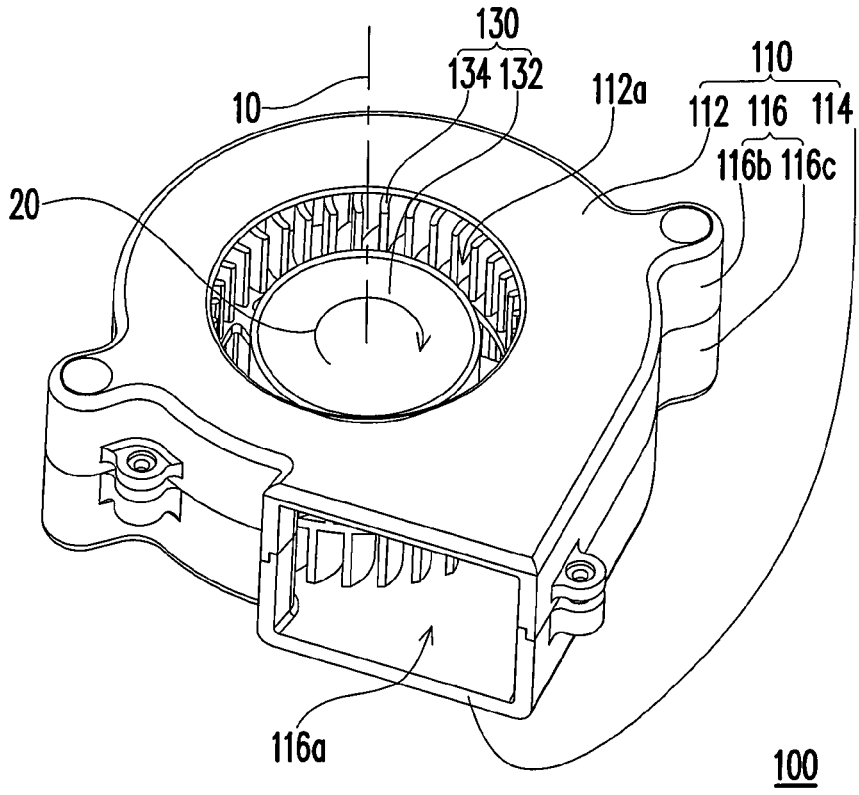
FIG. 1A(PRIOR ART)
FIG. 1A is a schematic perspective view of a conventional centrifugal blower.
Figure 1B:
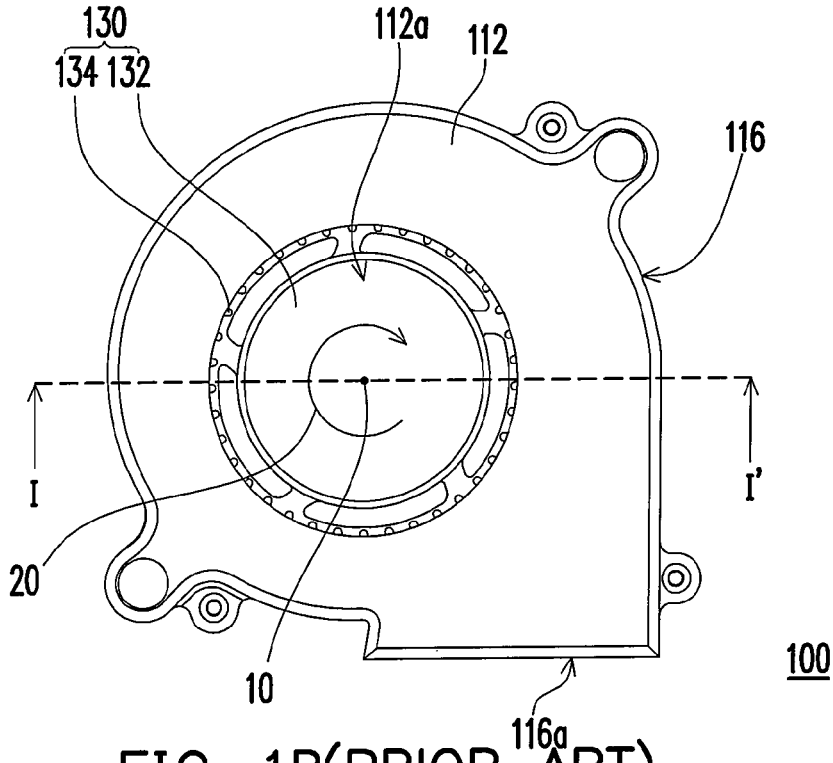
FIG. 1B(PRIOR ART)
FIG. 1B is a schematic top view of the centrifugal blower of FIG. 1A.
Figure 1C:
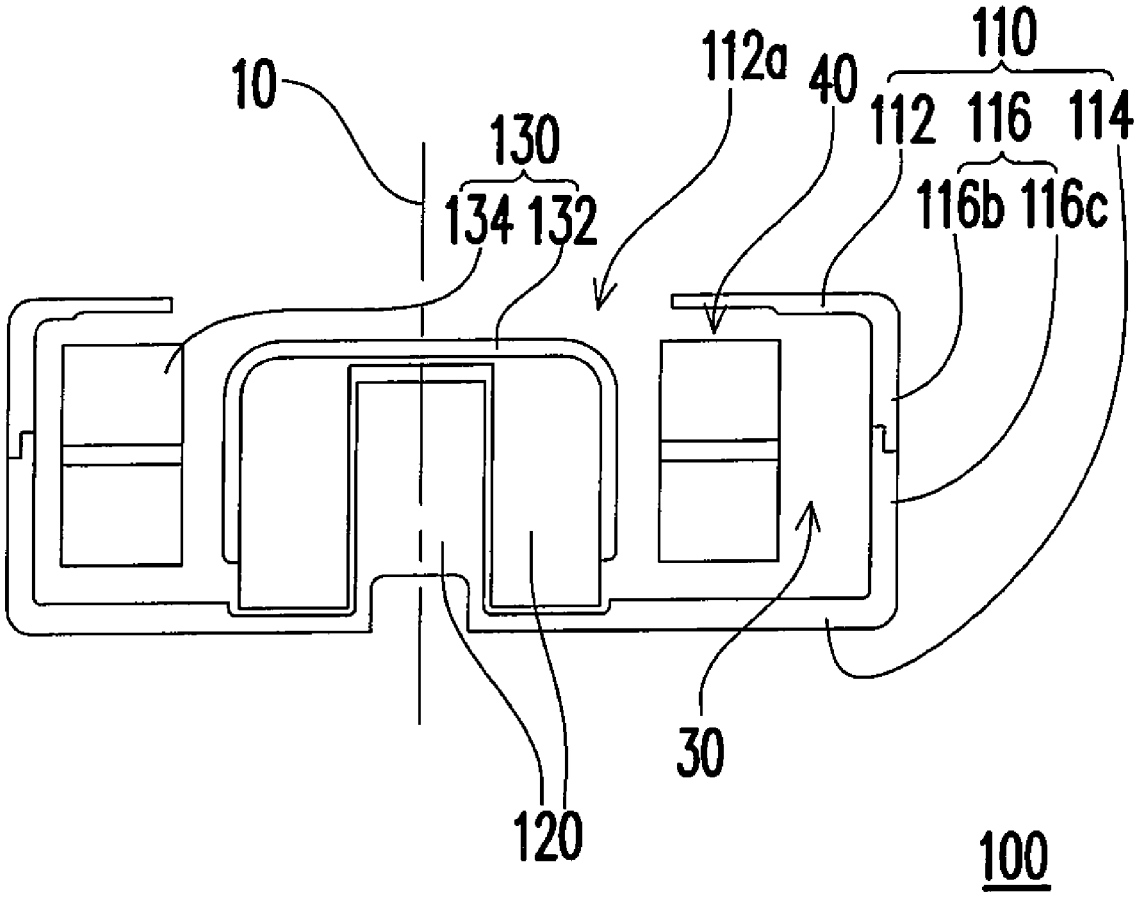
FIG. 1C(PRIOR ART)
FIG. 1C is a schematic cross-sectional view of the centrifugal blower of FIG. 1B taken along the line I-I'.
Figure 2A:
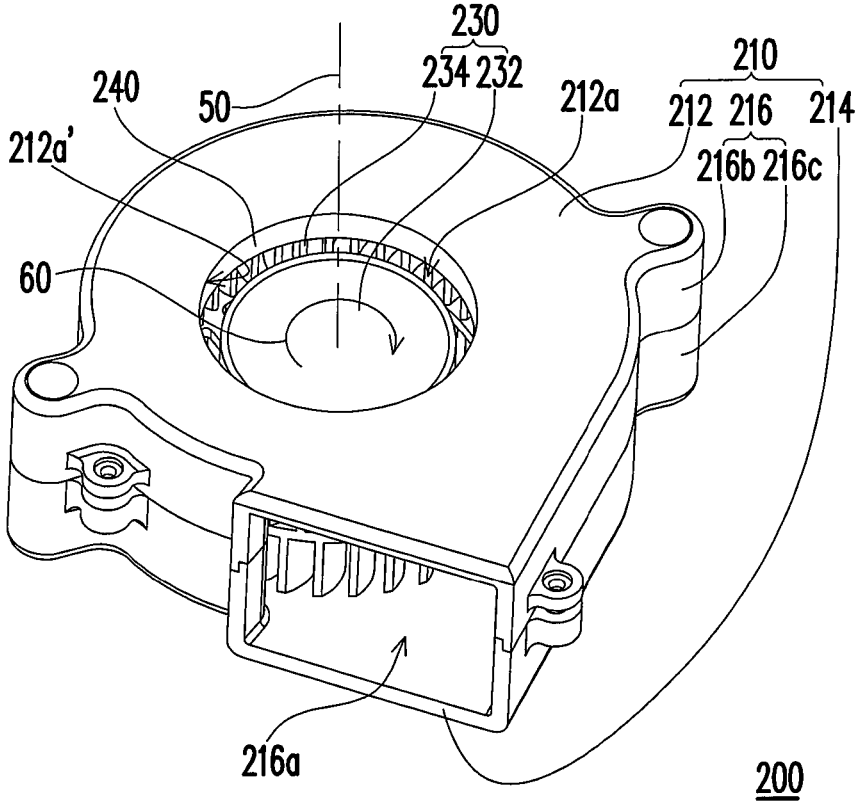
FIG. 2A is a schematic perspective view of a centrifugal blower according to a first embodiment of the present invention.
Figure 2B:
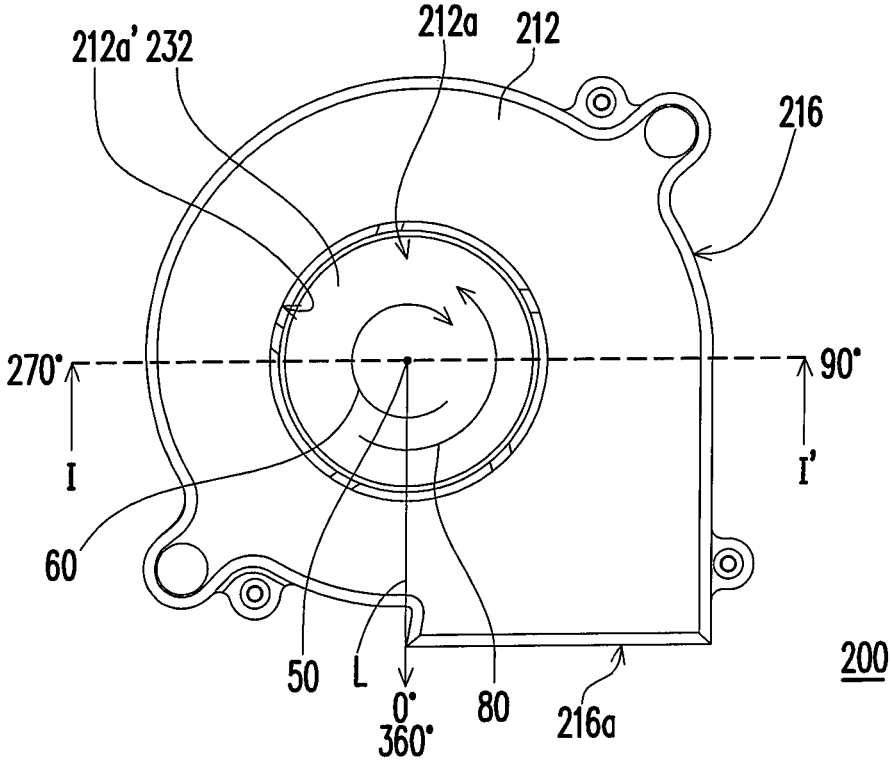
FIG. 2B is a schematic top view of the centrifugal blower of FIG. 2A.
Figure 2C:
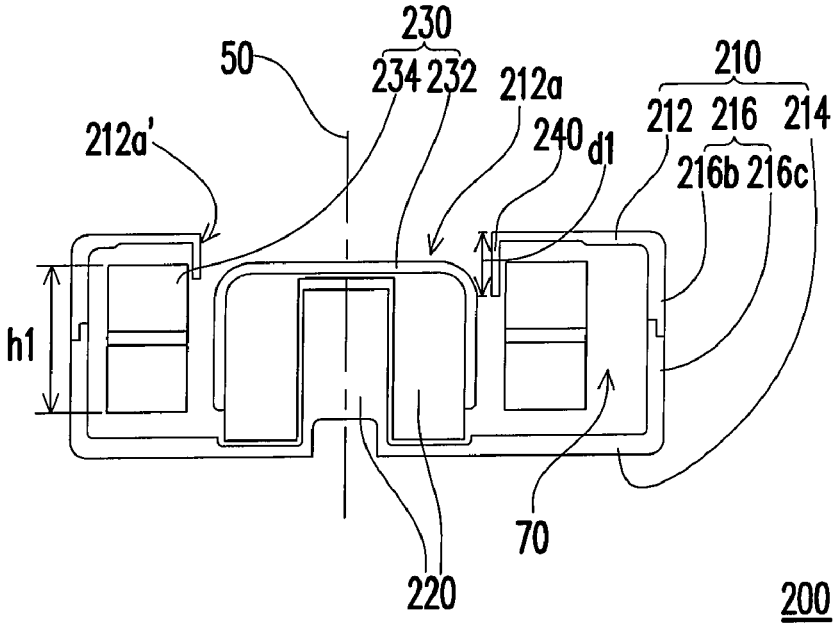
FIG. 2C is a schematic cross-sectional view of the centrifugal blower of FIG. 2B taken along the line I-I'.

FIG. 2A is a schematic perspective view of a centrifugal blower according to a first embodiment of the present invention, FIG. 2B is a schematic top view of the centrifugal blower of FIG. 2A, and FIG. 2C is a schematic cross-sectional view of the centrifugal blower of FIG. 2B taken along the line I-I'. Referring to FIGS. 2A, 2B, and 2C, a centrifugal blower 200 in the first embodiment includes a casing 210, a motor 220, a fan structure 230, and an anti-leakage element 240. The casing 210 has a top portion 212, a bottom portion 214, and a side wall 216. The top portion 212 has an inlet 212*a*. The side wall 216 respectively connects the top portion 212 and the bottom portion 214 and has an outlet 216*a*. The side wall 216 is formed in the following manners. One side 216*b* connected to the top portion 212 is engaged or connected in other manners with the other side 216*c* connected to the bottom portion 214. Or, the side wall 216 directly formed on the bottom portion 214 is connected to the top portion 212 by adhesive, melting, or other manners. Or, the side wall 216 directly formed on the top portion 212 is connected to the bottom portion 214 by adhesive, melting, or other manners.

The motor 220 is fixed in the casing 210. The fan structure 230 disposed in the casing 210 has a body 232 and a plurality of blades 234. The body 232 is connected to the motor 220. The blades 234 surrounding the body 232 are connected to the body 232. The fan structure 230 driven by the motor 220 rotates about an axis 50 in a rotation direction 60. In addition, as shown in FIG. 2C, the anti-leakage element 240 extends from at least part of an edge 212*a*' of the inlet 212*a* to an interior of the casing 210, and partially covers parts of the blades 234. In the first embodiment, the anti-leakage element 240 extends to the interior of the casing 210 in the direction of the bottom portion 214.

As the anti-leakage element 240 in the first embodiment extends from at least part of the edge 212*a*' of the inlet 212*a* to the interior of the casing 210, when the centrifugal blower 200 operates, the pressurized air within a volute chamber 70 located between the blades 234 and the side wall 216 does not easily leak. Therefore, the centrifugal blower 200 of the first embodiment has higher operation efficiency.

Figure 2D:
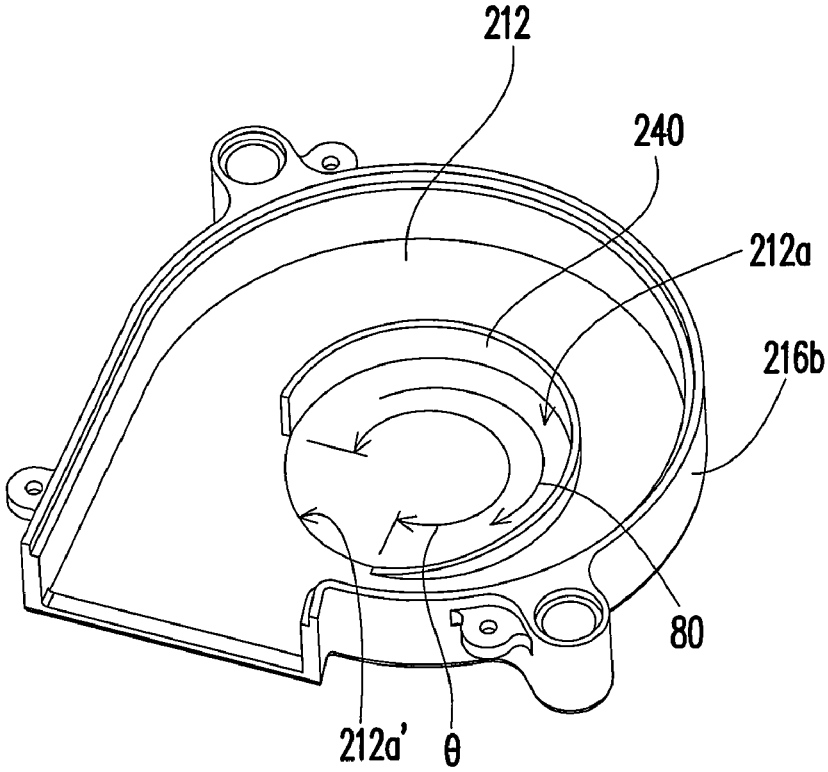
FIG. 2D is a schematic perspective view of a part of the casing and the anti-leakage element of the centrifugal blower of FIG. 2A.

FIG. 2D is a schematic perspective view of a part of the casing and the anti-leakage element of the centrifugal blower of FIG. 2A. Referring to FIGS. 2A, 2C, and 2D, the top portion 212, a part of the side wall 216 (i.e., the side edge 216*b*) of the casing 210 of the first embodiment and the anti-leakage element 240 are integrally formed to be a top cover, and the bottom portion 214 and a part of the side wall 216 (i.e., the side edge 216*c*) of the casing 210 are integrally formed to be a bottom cover. In addition, FIG. 2D shows a state when the top cover is turned over, so as to clearly show the profile of the anti-leakage element 240 according to the first embodiment.

Referring to FIGS. 2B, 2C, and 2D, in the first embodiment, the anti-leakage element 240 extends from neighborhood of the outlet 216*a* in another rotation direction 80 against the rotation direction 60. It should be noted that as for a polar coordinate with the axis 50 as the center as shown in FIG. 2B, the position of 0 degrees is defined as a ray L extending from the axis 50 in a direction of a place of the side wall 216, wherein the direction is perpendicular to the axis 50 and the place of the side wall 216 is at a minimum distance from the axis 50. In addition, the above mentioned "neighborhood of the outlet 216*a*" refers to positions between 0 degrees and 90 degrees with respect to the edge 212*a*' of the inlet 212*a*.

The anti-leakage element 240 of the first embodiment extending in the rotation direction 80 has an arc (as shown in FIG. 2D). A range of an angle θ of the arc with respect to the axis 50 is greater than 0 degrees and smaller than or equal to 270 degrees. In specific, referring to FIGS. 2B and 2D, in this embodiment, the anti-leakage element 240 extends from a position of 90 degrees of the polar coordinate to a position of 360 degrees of the polar coordinate in the rotation direction 80. In other embodiments, the anti-leakage element 240 extends from the position of 90 degrees of the polar coordinate to a position of 180 degrees of the polar coordinate in the rotation direction 80.

Referring to FIGS. 2B, 2C, and 2D, in the first embodiment, a range of the anti-leakage element 240 extending to the interior of the casing 210 is gradually reduced along the rotation direction 80. Particularly, in the first embodiment, the range covered by the anti-leakage element 240 at 90 degrees of the polar coordinate is large, and the range covered by the anti-leakage element 240 at 360 degrees of the polar coordinate is small. Furthermore, a maximum distance d1 of the anti-leakage element 240 extending to the interior of the casing 210 with respect to the top portion 212 is greater than or equal to a quarter of a height h1 of each of the blades 234 and smaller than or equal to half of the height h1 of each of the blades 234. Particularly, in the first embodiment, a maximum distance d1 of the anti-leakage element 240 extending to the interior of the casing 210 with respect to the top portion 212 is achieved at a position of 90 degrees of the polar coordinate (shown in FIGS. 2B and 2C).

As the range of the anti-leakage element 240 extending to the interior of the casing 210 in the first embodiment is gradually reduced along the rotation direction 80 as shown in FIG. 2D, when the centrifugal blower 200 operates, the air within the casing has a static pressure gradually increased along the rotation direction 60, so it does not easily leak. Furthermore, the intake rate of air at the inlet 212*a* is not easily affected to greatly decrease by the anti-leakage element 240.

The Second Embodiment

Figure 3:
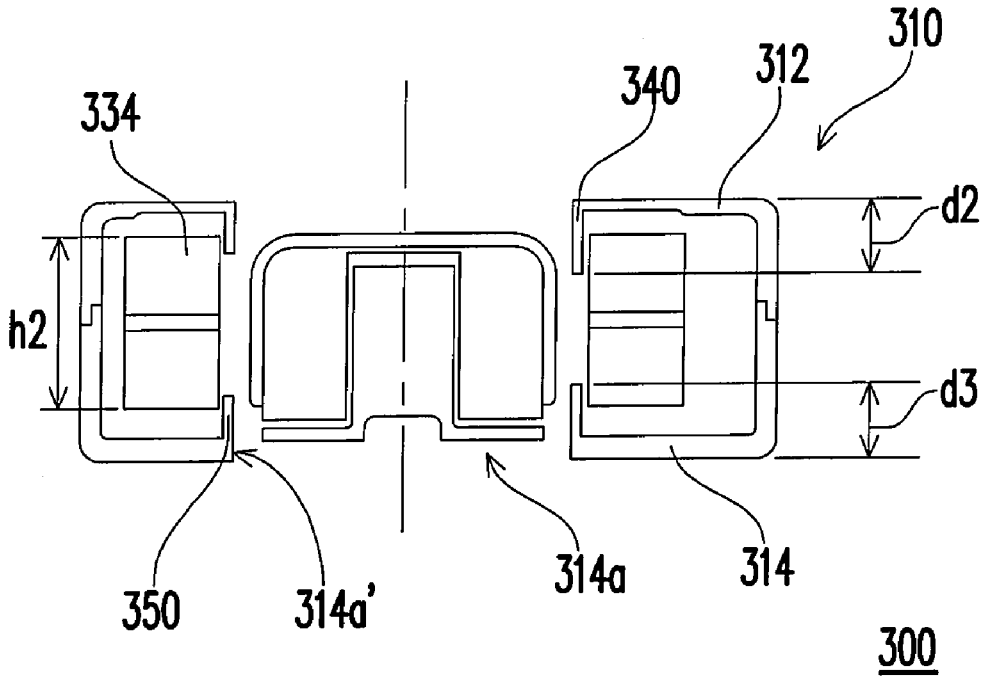
FIG. 3 is a schematic cross-sectional view of a centrifugal blower according to a second embodiment of the present invention.

FIG. 3 is a schematic cross-sectional view of a centrifugal blower according to a second embodiment of the present invention. Referring to FIG. 3, the difference between the second embodiment and the first embodiment mainly lies in that the bottom portion 314 of the casing 310 of the centrifugal blower 300 of the second embodiment has another inlet 314*a*, and the centrifugal blower 300 further includes another anti-leakage element 350. The anti-leakage element 350 extends from at least part of an edge 314*a*' of the inlet 314*a* to the interior of the casing 310, and partially covers parts of the blades 334.

In the second embodiment, a maximum distance d2 of the anti-leakage element 340 extending to the interior of the casing 310 with respect to the top portion 312 is greater than or equal to one eighth of a height h2 of each of the blades 334 and smaller than or equal to a quarter of the height h2 of each of the blades 334. A maximum distance d3 of the anti-leakage element 350 extending to the interior of the casing 310 with respect to the bottom portion 314 is greater than or equal to one eighth of the height h2 of each of the blades 334 and smaller than or equal to a quarter of the height h2 of each of the blades 334.

In addition, the positions, extending manners, and functions of the anti-leakage element 340 in the second embodiment are similar to those of the anti-leakage element 240 of the first embodiment, and the details will not be further described herein again. Furthermore, the profile and position of the anti-leakage element 350 in the second embodiment are corresponding to those of the anti-leakage element 340. In specific, the inlet 212*a* is corresponding to the inlet 314*a*, and the anti-leakage element 340 is corresponding to the anti-leakage element 350.

The Third Embodiment

Figure 4:
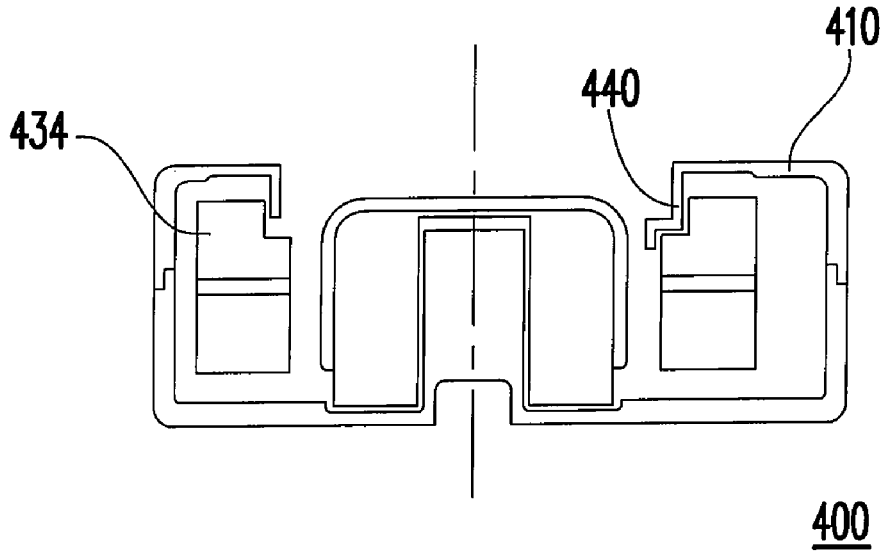
FIG. 4 is a schematic cross-sectional view of a centrifugal blower according to a third embodiment of the present invention.

FIG. 4 is a schematic cross-sectional view of a centrifugal blower according to a third embodiment of the present invention. Referring to FIG. 4, the difference between the third embodiment and the first embodiment mainly lies in that the profile of each of the blades 434 of the centrifugal blower 400 of the third embodiment is different from that of each of the blades 234 of the centrifugal blower 200 in the first embodiment. It should be noted that the anti-leakage element 440 extends to the interior of the casing 410 corresponding to the profile of each of the blades 434.

To sum up, the centrifugal blower according to the embodiments of present invention at least has one or part of or all of the following advantages.

1. The anti-leakage element of the present invention extends from at least part of the edge of the inlet to the interior of the casing, so when the centrifugal blower of the present invention operates, the air pressurized by the blades within the casing does not easily leak. Therefore, the centrifugal blower of the present invention has higher operation efficiency.

2. The range of the anti-leakage element of the present invention extending to the interior of the casing is gradually reduced against the rotation direction in which the fan structure rotates, so when the centrifugal blower operates, the air within the casing having a static pressure gradually increased along the rotation direction in which the fan structure rotates does not easily leak. Furthermore, the intake rate of air at the inlet is not easily affected to greatly decrease by the anti-leakage element.

The foregoing description of the preferred embodiment of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like is not necessary limited the claim scope to a specific embodiment, and the reference to particularly preferred exemplary embodiments of the invention does not imply a limitation on the invention, and no such limitation is to be inferred. The invention is limited only by the spirit and scope of the appended claims. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A centrifugal blower, comprising:

a casing, having a top portion, a bottom portion and a side wall, the top portion having a first inlet, and the side wall respectively connecting the top portion and the bottom portion and having an outlet;

a motor, fixed in the casing;

a fan structure, disposed in the casing, the fan structure having a body connected to the motor and a plurality of blades surrounding the body, the blades being connected to the body, and the fan structure driven by the motor rotating about an axis in a first rotation direction; and a first anti-leakage element, extending from at least part of a first edge of the first inlet to an interior of the casing and partially covering parts of the blades, wherein the first anti-leakage element extends from neighborhood of the outlet in a second rotation direction against the first rotation direction, and a range of the first anti-leakage element extending to the interior of the casing is gradually reduced along the second rotation direction.

2. The centrifugal blower as claimed in claim 1, wherein the first anti-leakage element extending in the second rotation direction has an arc and a range of an angle of the arc with respect to the axis is greater than 0 degrees and smaller than or equal to 270 degrees.

3. The centrifugal blower as claimed in claim 1, wherein a maximum distance of the first anti-leakage element extending to the interior of the casing with respect to the top portion is greater than or equal to a quarter of a height of each of the blades and smaller than or equal to half of the height of each of the blades.

4. The centrifugal blower as claimed in claim 1, wherein the bottom portion has a second inlet.

5. The centrifugal blower as claimed in claim 4, further comprising a second anti-leakage element extending from at least part of a second edge of the second inlet to the interior of the casing and partially covering parts of the blades.

6. The centrifugal blower as claimed in claim 5, wherein the second anti-leakage element extends from the neighborhood of the outlet in a second rotation direction against the first rotation direction.

7. The centrifugal blower as claimed in claim 6, wherein a range of the second anti-leakage element extending to the interior of the casing is gradually reduced along the second rotation direction.

8. The centrifugal blower as claimed in claim 6, wherein the second anti-leakage element extending in the second rotation direction has an arc and a range of an angle of the arc with respect to the axis is greater than 0 degrees and smaller than or equal to 270 degrees.

9. The centrifugal blower as claimed in claim 5, wherein a first maximum distance of the first anti-leakage element extending to the interior of the casing with respect to the top portion is greater than or equal to one eighth of a height of each of the blades and smaller than or equal to a quarter of the height of each of the blades, and a second maximum distance of the second anti-leakage element extending to the interior of the casing with respect to the bottom portion is greater than or equal to one eighth of each of the blades and smaller than or equal to a quarter of the height of each of the blades.

10. The centrifugal blower as claimed in claim 5, wherein the first inlet is corresponding to the second inlet, and the first anti-leakage element is corresponding to the second anti-leakage element.

* * * * *